US006761435B1

(12) United States Patent
Powers

(10) Patent No.: US 6,761,435 B1
(45) Date of Patent: Jul. 13, 2004

(54) INKJET PRINTHEAD HAVING BUBBLE CHAMBER AND HEATER OFFSET FROM NOZZLE

(75) Inventor: James H. Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/396,657

(22) Filed: Mar. 25, 2003

(51) Int. Cl.[7] ..... B41J 2/05
(52) U.S. Cl. ..... 347/65
(58) Field of Search ..... 347/56, 62, 63, 347/65; 219/216; 338/306–309

(56) References Cited

U.S. PATENT DOCUMENTS

| | | | | |
|---|---|---|---|---|
| 4,367,480 | A | | 1/1983 | Kotoh |
| 4,794,411 | A | | 12/1988 | Taub et al. |
| 5,087,930 | A | | 2/1992 | Roy et al. |
| 5,394,181 | A | | 2/1995 | Braun |
| 5,455,615 | A | | 10/1995 | Burr et al. |
| 6,003,986 | A | | 12/1999 | Keefe |
| 6,010,208 | A | | 1/2000 | Powers et al. |
| 6,113,223 | A | | 9/2000 | Tanaka et al. |
| 6,130,693 | A | | 10/2000 | Ims et al. |
| 6,193,356 | B1 | | 2/2001 | Takata |
| 6,305,790 | B1 | * | 10/2001 | Kawamura et al. ..... 347/56 |
| 6,343,857 | B1 | | 2/2002 | Cowger |
| 6,371,600 | B1 | | 4/2002 | Murthy et al. |
| 6,398,850 | B1 | | 6/2002 | Field et al. |
| 6,402,311 | B1 | | 6/2002 | Inoue et al. |
| 6,443,564 | B1 | | 9/2002 | Keil et al. |

* cited by examiner

*Primary Examiner*—Michael S Brooke
(74) *Attorney, Agent, or Firm*—King & Schickli, PLLC

(57) ABSTRACT

In an inkjet printhead, a substantially rectangular heater element has an aspect ratio greater than about 2.0. A bubble chamber surrounds a centrally disposed heater element with a plurality of walls. A nozzle plate has an orifice for projecting ink from the bubble chamber that axially extends through a thickness thereof. A center of the orifice originates a plumb line such that an offset distance exists from a center of the heater element in a range from about 6 to about 10 microns. An ink flow channel through one of the bubble chamber walls has a primary direction of ink flow substantially paralleling a length dimension of the heater element. The bubble chamber and ink flow channel may exist in the nozzle plate, a polymer barrier layer or a plurality of film layers that define a heater chip. More preferred aspect ratios include greater than about 2.5 and about 4.0.

20 Claims, 6 Drawing Sheets

INKJET PRINTHEAD HAVING BUBBLE CHAMBER AND HEATER OFFSET FROM NOZZLE

FIELD OF THE INVENTION

The present invention relates to inkjet printheads. In particular, it relates to an arrangement of a bubble chamber and heater element in a printhead having a substantial offset from an orifice or nozzle of a nozzle plate.

BACKGROUND OF THE INVENTION

The art of inkjet printing is relatively well known. In general, an image is produced by emitting ink drops from a printhead at precise moments such that they impact a print medium at a desired location. The printhead is supported by a movable print carriage within a device, such as an inkjet printer, and is caused to reciprocate relative to an advancing print medium and to emit ink drops at times pursuant to commands of a microprocessor or other controller. The timing of the ink drop emissions corresponds to a pattern of pixels of the image being printed. Other than printers, familiar devices incorporating inkjet technology include fax machines, all-in-ones, photo printers, and graphics plotters, to name a few.

A conventional thermal inkjet printhead includes access to a local or remote supply of color or mono ink, a heater chip, a barrier layer, a nozzle or orifice plate attached or formed with the heater chip, and an input/output connector, such as a tape automated bond (TAB) circuit, for electrically connecting the heater chip to the printer during use. The heater chip, in turn, typically includes a plurality of thin film resistors or heater elements fabricated by deposition, masking and etching techniques on a substrate such as silicon.

To print or emit a single drop of ink, an individual heater is uniquely addressed with a predetermined amount of current to rapidly heat a small volume of ink. This causes the ink to vaporize in a local bubble chamber (between the heater and nozzle plate) and to be ejected through and projected by the nozzle plate towards the print medium.

With reference to FIGS. 1*a* and 1*b*, a typical geometry of a heater element 10 and a bubble chamber 12 relative to an orifice 14 in a nozzle plate 15 includes a substantially centered and symmetrical relationship. In particular, a plumb line 28 originating from an orifice center 30 has no lateral offset from a heater center 32. In addition, the orifice center exists substantially equidistant from each corner of the bubble chamber. As a result, stagnant regions 22 of the bubble chamber 12 serve to trap air bubbles in ink 16 that flows into the bubble chamber (through ink channel 20 and ink via 18) during use. Over time, trapped bubbles accumulate and grow large enough to prevent heat transfer from the heater element to the ink which eventually stops operation.

Accordingly, a need exists to prevent air bubble formation and accumulation in inkjet printheads.

SUMMARY OF THE INVENTION

The above-mentioned and other problems become solved by applying the principles and teachings associated with the hereinafter described printhead having a bubble chamber and heater element offset relative to a nozzle or orifice in a nozzle plate.

In one embodiment, the invention teaches an inkjet printhead with a substantially rectangular heater element. By dividing a length dimension by a width dimension, the heater element has an aspect ratio of more than about 2.0. More preferably, it has an aspect ratio of more than about 2.5, 4.0 or 5.0 or greater. A bubble chamber substantially surrounds the heater element with a plurality of walls that reside substantially equidistant from a periphery of the heater element. A nozzle plate covers the bubble chamber and has an orifice axially extending through a thickness thereof. A center of the orifice originates a plumb line such that an offset distance exists from a center of the heater element in a range from about 6 to about 10 microns, for example. An ink flow channel through one of the bubble chamber walls has a primary direction of ink flow substantially paralleling a length dimension of the heater element. The bubble chamber and ink flow channel may exist in the nozzle plate, in a barrier layer or in a plurality of film layers that define a heater chip. Inkjet printheads and inkjet printers for housing the printheads are also disclosed.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

FIG. 4 is a perspective view in accordance with the teachings of the present invention of an inkjet printhead with a heater chip having a bubble chamber and heater element offset relative to a nozzle; and.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the inventions may be practiced. These embodiments are described in sufficient detail to enable those skilled in the art to practice the invention, and it is to be understood that other embodiments may be utilized and that process or other changes may be made without departing from the scope of the present invention. The following detailed description is, therefore, not to be taken in a limiting sense, and the scope of the present invention is defined only by the appended claims and their equivalents. In accordance with the present invention, an inkjet printhead bubble chamber and heater element having an offset from a nozzle or orifice of a nozzle plate is hereinafter described.

Figure 2A:
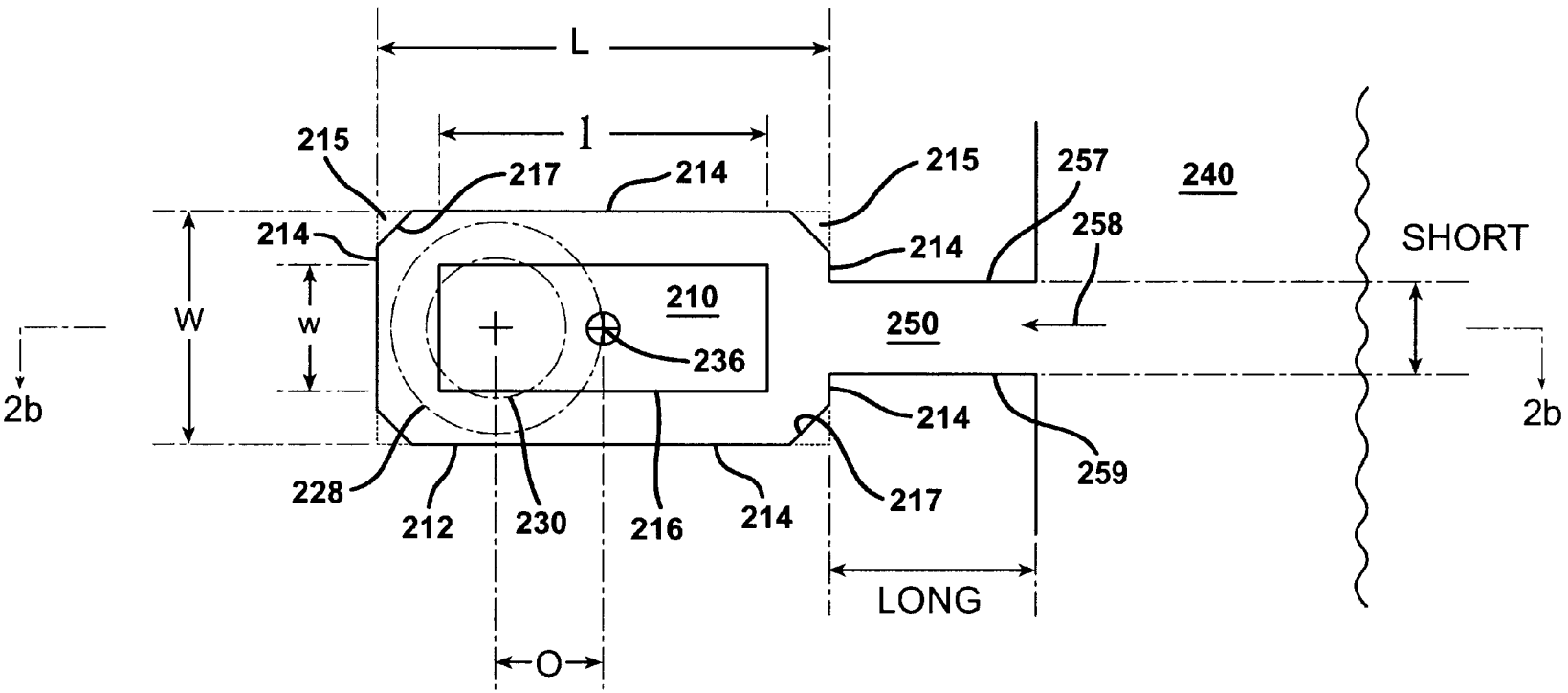
FIG. 2*a* is a diagrammatic top view in accordance with the teachings of the present invention of an inkjet printhead bubble chamber and heater element offset relative to a nozzle.
Figure 2B:
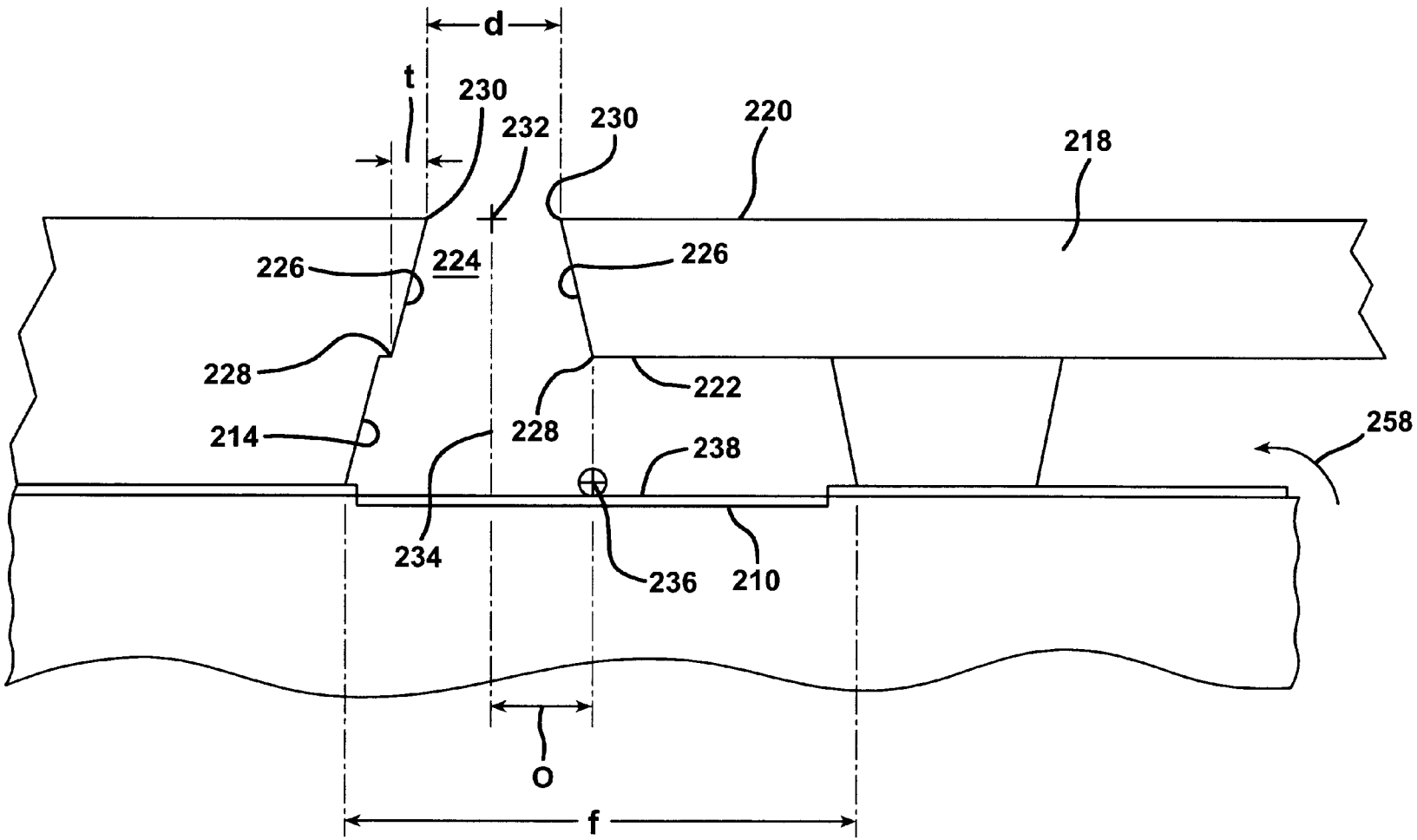
FIG. 2*b* is a partial side view of the inkjet printhead bubble chamber and heater element of FIG. 2*a* taken along line 2*b*—2*b;*

With reference to FIGS. 2*a* and 2*b,* a heater element 210 for heating ink in an inkjet printhead has a substantially rectangular shape defined by a length l and width w dimension. In one embodiment, an aspect ratio of the length dimension to the width dimension is greater than about 2.0. In another embodiment, the aspect ratio is greater than about 2.5. Preferably, the length dimension is about 35.6 microns while the width dimension is about 13.2 microns. In still another embodiment, the aspect ratio is about 4.0. Specifically, the length dimension is about 40 microns while the width dimension is about 10 microns. In still other embodiments, the aspect ratio is about 5.0 or greater.

Substantially surrounding the heater element is a bubble chamber 212 having a plurality of walls 214. In cross section, the walls 214 rise above the heater element 210 to provide a chamber in which ink can become heated to form a bubble as is well know in the art. Each of the walls resides substantially equidistant from a periphery 216 of the heater element such that the heater element is substantially centered within the bubble chamber. The walls 214 of the bubble chamber are substantially perpendicular to one another and define length L and width W distances substantially paralleling the length and width dimensions of the heater element. In one embodiment, the length distance is about 42 microns while the width distance is about 31 microns. In another embodiment, any, some or all of the comer regions 215 (two of the four labeled) of the bubble chamber have a chamfer cut 217. They may additionally include fillets or other.

Above the bubble chamber is a nozzle plate 218 that attaches by epoxy or the like or is formed as one or more of a series of polymer layers or thin-film layers of a heater chip. In one embodiment, the nozzle plate has a first surface 220 and a second surface 222 that define a thickness thereof. Axially extending through the nozzle plate from the second to the first surface is an orifice 224 for ejecting and projecting ink there through during use. Preferably, but not necessarily required, the shape of the orifice comprises a frustum conical shape defined by sloping walls 226 having a large diameter opening 228 at one end thereof and a small diameter opening 230 at the other end thereof. (For simplicity in FIG. 2*a*, openings 228 and 230 are shown superimposed in phantom.) As a representative example, present day printheads have small diameter openings on the order of about 11 or 14 microns. In the future, it is expected that this dimension will gradually shrink as printing resolutions increase from 600 DPI (dots-per-inch) to 900 or 1200 DPI or more.

In a plane substantially parallel with the first surface 220 of the nozzle plate, the orifice 224 has an orifice center 232. A plumb line 234 originating from the orifice center has an offset distance O from a center 236 formed on a surface 238 of the heater element 210. In one embodiment, the offset distance O is about 6 to about 10 micrometers in a straight line distance on the surface 238 of the heater and all within the periphery 216. In another embodiment, it is about 8.0 or 8.5 microns. In still another embodiment, it ranges from about 6 to about 18 microns. According to one preferred embodiment, the maximum offset is calculated according to the formula ½ (f−(d+2t)).

Figure 1A:
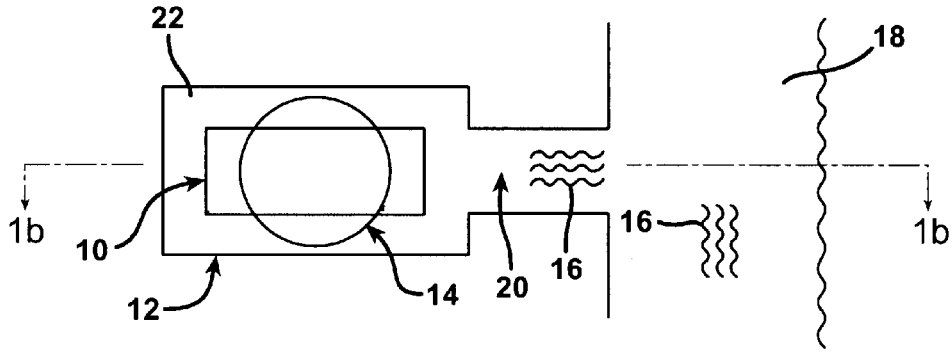
FIG. 1a PRIOR ART
FIG. 1*a* is a diagrammatic top view in accordance with the teachings of the prior art of an inkjet printhead bubble chamber and heater symmetrically centered relative to a nozzle.
Figure 1B:
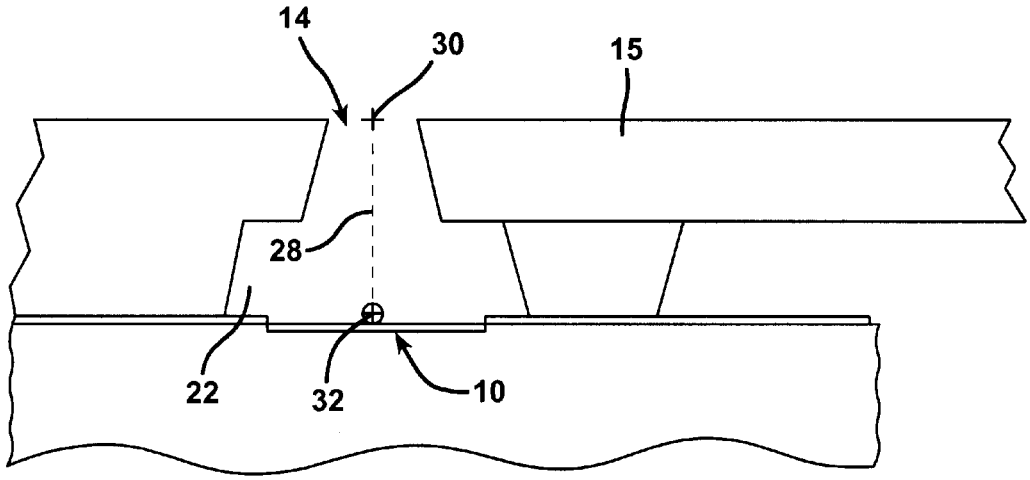
FIG. 1b PRIOR ART
FIG. 1*b* is a partial side view of the inkjet printhead bubble chamber and heater of FIG. 1*a* taken along line 1*b*—1*b;*

It should now be appreciated this offset essentially translates prior art orifices from a central position above the heater element to a backside of the bubble chamber in a direction away from the ink via 240. In this manner, stagnant regions (element 22, FIGS. 1*a*, 1*b*) of the prior art become effectively eliminated. In turn, the formation and accumulation of air bubbles in a single bubble chamber over time becomes lessened or eliminated. In one actual experiment by the inventor, first pass print tests of an inkjet printhead having these offsets revealed an increase of about 10 to 20% in population-wide functional test yields.

Further connected to the bubble chamber, through a wall thereof on a side closest to the ink via 240, is an ink flow channel 250 having a long and short dimension of about 22 microns and 18 microns, respectively. Two substantially parallel walls 257, 259 define the ink flow channel and a primary direction of ink flow therein. The walls exist substantially perpendicular to a longitudinal extent of the ink via 240 and substantially parallel to the length dimension of the heater element. During use, ink 258 flows through the ink channel in a primary direction substantially paralleling the length dimension I of the heater element on the surface 238 thereof. Ink is ejected through the orifice 224 in a direction substantially transverse to the primary direction. Further operation of the printhead will be described below.

Appreciating that an individual heater element is one of many heater elements on a heater chip, skilled artisans know the economy of scale achieved by fabricating the heater elements as thin film layers on a substrate through a series of growth layers, deposition layers, masking, patterning, photolithography, and/or etching or other processing steps. In a preferred embodiment, the thin film layers include, but are not limited to: a base substrate (including any base semiconductor structure such as silicon-sapphire (SOS) technology, silicon-on-insulator (SOI) technology, thin film transistor (TFT) technology, doped and undoped semiconductors, epitaxial layers of silicon supported by a base semiconductor structure, as well as other semiconductor structures known or hereinafter developed); a thermal barrier layer on the substrate; a heater or resistor layer on the thermal barrier layer; a conductor layer (bifurcated into positive and negative electrode sections, i.e., anodes and cathodes) on the resistor layer to heat the resistor layer through thermal conductivity during use; passivation layers, such as SiC and/or SiN; and a cavitation layer on the passivation layer(s).

Accordingly, in another depiction of the invention (FIG. 3), the heater element 310 is formed on a substrate 360 in the manner described. The bubble chamber 312 surrounds the heater element with a plurality of walls 314. A nozzle plate 318 has an orifice 334 cut therein and overlies the bubble chamber. A plumb line originating from a center of the orifice intersects a surface of the heater element at a position 334. In turn, a center 336 of the heater element is offset from position 334 in a straight line distance of about 6 to about 10 micrometers. Ink 358 flows into the bubble chamber during use through an ink channel 350 cut through one of the walls 314.

Figure 3:
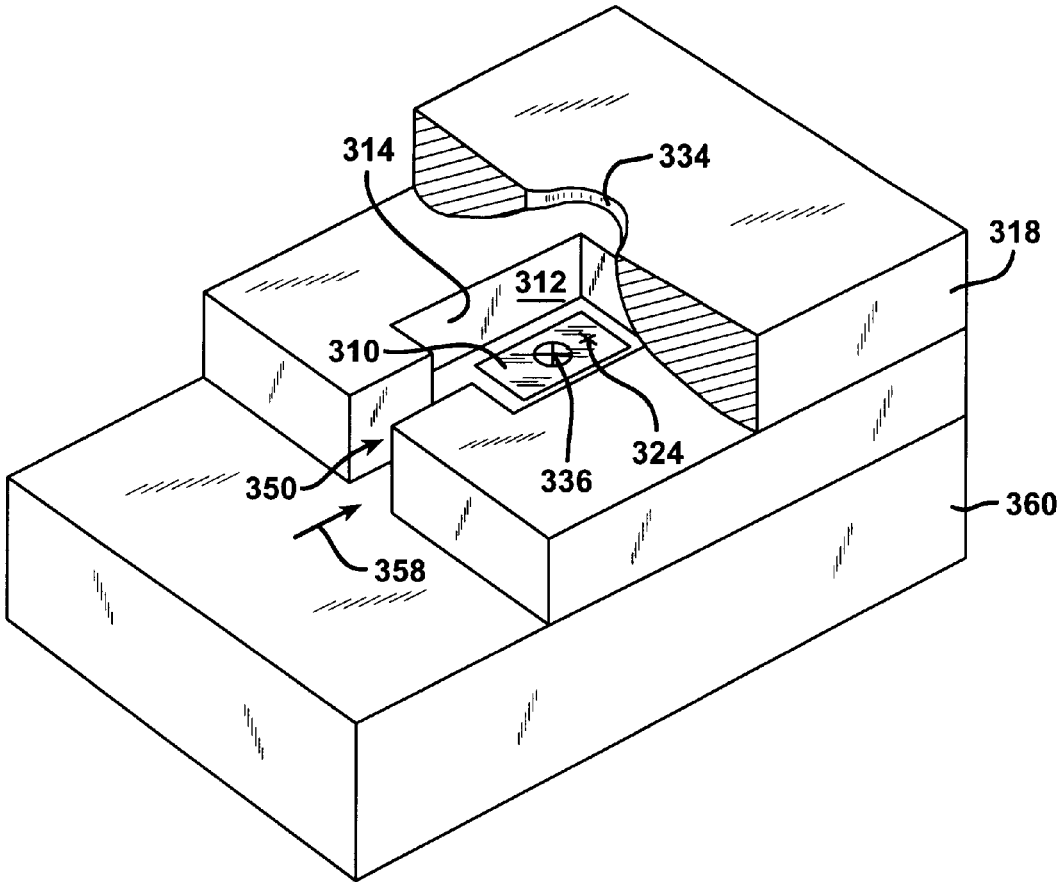
FIG. 3 is a perspective view in accordance with an alternative embodiment of the present invention of an inkjet printhead bubble chamber and heater element offset relative to a nozzle.

By comparing FIGS. 2*a,* 2*b* with FIG. 3, those skilled in the art should further appreciate that either one or both of the bubble chamber and ink flow channel can be formed as a series of thin film or polymer layers or as part of a nozzle plate. They should also appreciate that the nozzle plate itself can be formed as a series of thin film or polymer layers or as a separate structure later aligned and fastened over the bubble chamber. All embodiments and variations are embraced herein.

In various embodiments of thin film processing, the layers become deposited by any variety of chemical vapor depositions (CVD), physical vapor depositions (PVD), epitaxy, ion beam deposition, evaporation, sputtering or other similarly known techniques. Preferred CVD techniques include low pressure (LP), atmospheric pressure (AP), plasma enhanced (PE), high density plasma (HDP) or other. Preferred etching techniques include, but are not limited to, any variety of wet or dry etches, reactive ion etches, deep reactive ion etches, etc. Preferred barrier layer or ink flow channel feature formation techniques include polymer layer deposition, followed by photolithographic and image development techniques; or laser ablation techniques applied to a polymer film. Preferred photolithography steps include, but are not limited to, exposure to ultraviolet or x-ray light sources, or other and photomasking includes clear-field or dark-field masks as those terms are well understood in the art.

In still other embodiments, the substrate comprises a silicon wafer of p-type, 100 orientation, having a resistivity of 5–20 ohm/cm. Its beginning thickness is preferably, but not necessarily required, any one of 525+/−20 microns, 625+/−20 microns, or 625+/−15 microns with respective wafer diameters of 100+/−0.50 mm, 125+/−0.50 mm, and 150+/−0.50 mm.

The thermal barrier layer overlying the substrate includes a silicon oxide layer mixed with a glass such as BPSG, PSG or PSOG with an exemplary thickness of about 0.5 to about 3 microns, especially 1.82+/−0.15 microns. This layer can be deposited or grown according to manufacturing preference.

The heater element layer on the thermal barrier layer is about a 50-50% tantalum-aluminum composition layer of about 900 or 1000 angstroms thick. In other embodiments, the resistor layer includes essentially pure or composition layers of any of the following: hafnium, Hf, tantalum, Ta, titanium, Ti, tungsten, W, hafnium-diboride, $HfB_2$, Tantalum-nitride, $Ta_2N$, TaAl(N,O), TaAlSi, TaSiC, Ta/TaAl layered resistor, Ti(N,O), WSi(O) and the like.

A conductor layer overlying portions of the heater layer includes an anode and a cathode. In one embodiment, the conductor layer is about a 99.5–0.5% aluminum-copper composition of about 5000+/−10% angstroms thick. In other embodiments, the conductor layer includes pure or compositions of aluminum with 2% copper and aluminum with 4% copper.

Figure 4:
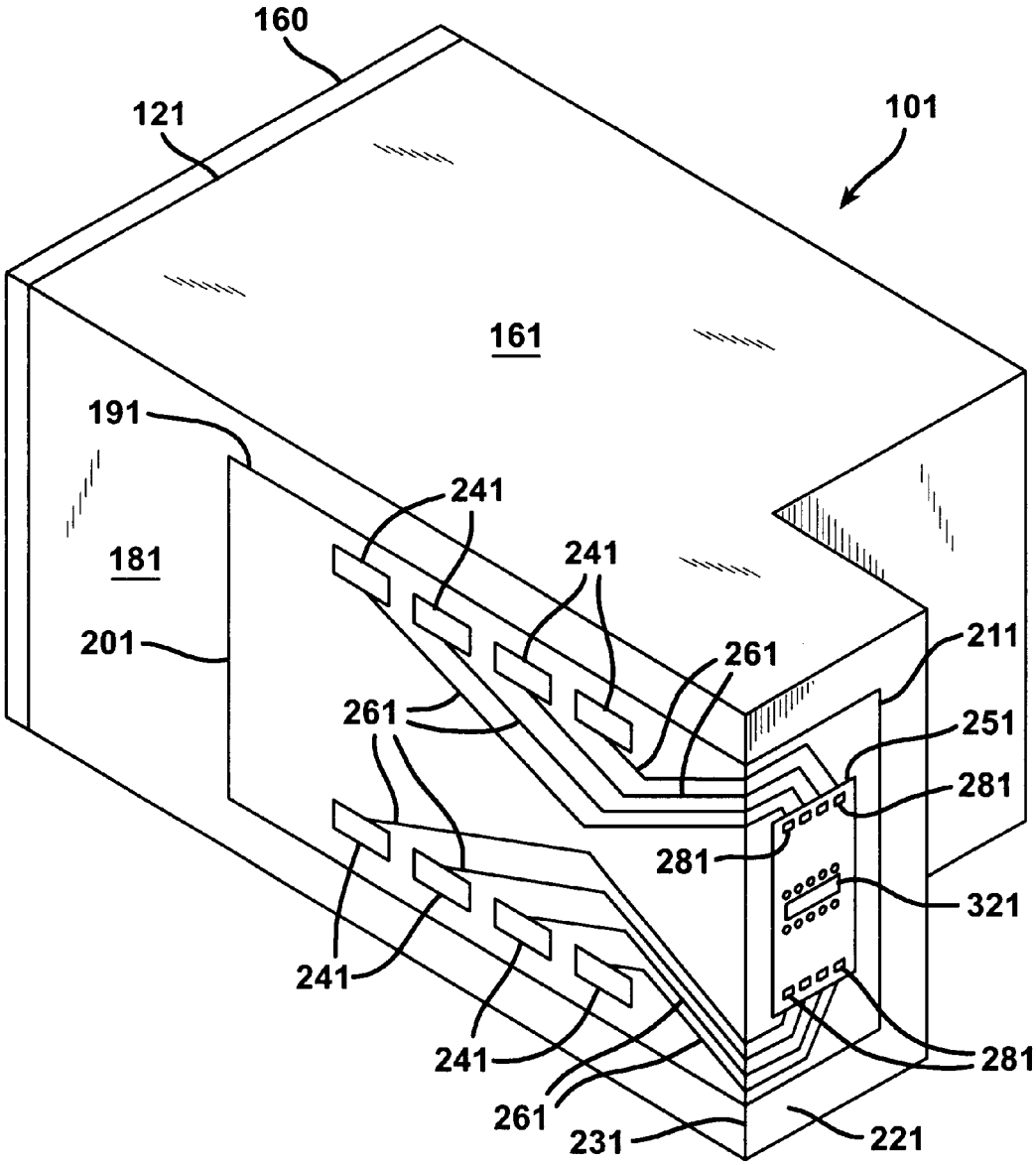

With reference to FIG. 4, a printhead of the present invention is shown generally as 101. The printhead 101 has a housing 121 formed of a body 161 and a lid 160. Although shown generally as a rectangular solid, the housing shape varies and depends upon the external device that carries or contains the printhead. The housing has at least one compartment, internal thereto, for holding an initial or refillable supply of ink and a structure, such as a foam insert, lung or other, maintains an appropriate backpressure therein during use. In another embodiment, the internal compartment includes three chambers for containing three supplies of ink, especially cyan, magenta and yellow ink. In other embodiments, the compartment may contain black ink, photo-ink and/or plurals of cyan, magenta or yellow ink. It will be appreciated that fluid connections (not shown) may exist to connect the compartment(s) to a remote source of ink.

A portion 191 of a tape automated bond (TAB) circuit 201 adheres to one surface 181 of the housing while another portion 211 adheres to another surface 221. As shown, the two surfaces 181, 221 exist substantially perpendicularly to one another about an edge 231.

The TAB circuit 201 has a plurality of input/output (I/O) connectors 241 fabricated thereon for electrically connecting a heater chip 251 to an external device, such as a printer, fax machine, copier, photo-printer, plotter, all-in-one, etc., during use. Pluralities of electrical conductors 261 exist on the TAB circuit 201 to electrically connect and short the I/O connectors 241 to the bond pads 281 of the heater chip 251 and various manufacturing techniques are known for facilitating such connections. Skilled artisans should appreciate that while eight I/O connectors 241, eight electrical conductors 261 and eight bond pads 281 are shown, any number are possible and the invention embraces all variations. The invention also embraces embodiments where the number of connectors, conductors and bond pads do not equal one another.

The heater chip 251 contains at least one ink via 321 with a longitudinal extent (alternatively: ink via 240 with a longitudinal extent in FIGS. 2*a*, 2*b*) that fluidly connects the heater chip to a supply of ink internal to the housing. During printhead manufacturing, the heater chip 251 preferably attaches to the housing with any of a variety of adhesives, epoxies, etc. well known in the art. As shown, the heater chip contains two columns of heater elements on either side of via 321. For simplicity in this crowded figure, dots or small circles depict the heater elements in the columns. A nozzle plate (218 or 318 FIG. 2*a*, 2*b* or 3) with pluralities of orifices adheres over the heater chip such that the nozzle holes align with the heaters. Alternatively, the nozzle plate adheres to a (polymer) barrier layer which then adheres to the heater chip.

Figure 5:
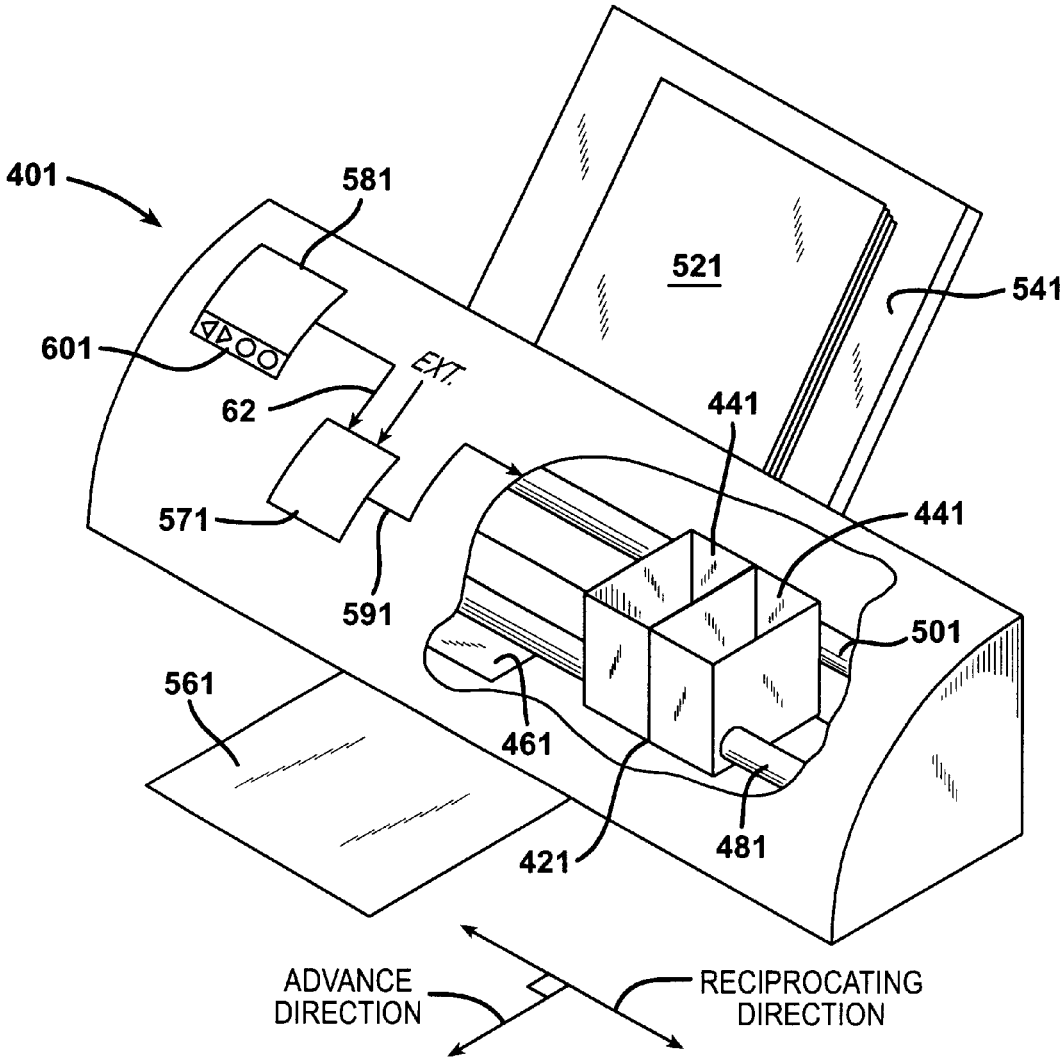
FIG. 5 is a perspective view in accordance with the teachings of the present invention of an inkjet printer for housing an inkjet printhead with a bubble chamber and heater element offset relative to a nozzle.

With reference to FIG. 5, an external device in the form of an inkjet printer contains the printhead 101 and is shown generally as 401. The printer 401 includes a carriage 421 having a plurality of slots 441 for containing one or more printheads. The carriage 421 is caused to reciprocate (via an output 591 of a controller 571) along a shaft 481 above a print zone 461 by a motive force supplied to a drive belt 501 as is well known in the art. The reciprocation of the carriage 421 is performed relative to a print medium, such as a sheet of paper 521, that is advanced in the printer 401 along a paper path from an input tray 541, through the print zone 461, to an output tray 561.

In the print zone, the carriage 421 reciprocates in the Reciprocating Direction generally perpendicularly to the paper Advance Direction as shown by the arrows. Ink drops from the printheads (FIG. 4) are caused to be ejected from the heater chip at such times pursuant to commands of a printer microprocessor or other controller 571. The timing of the ink drop emissions corresponds to a pattern of pixels of the image being printed. Often times, such patterns are generated in devices electrically connected to the controller (via Ext. input) that are external to the printer such as a computer, a scanner, a camera, a visual display unit, a personal data assistant, or other.

To print or emit a single drop of ink, the heater element is uniquely addressed with a short pulse of current to rapidly heat a small volume of ink. This causes the ink to vaporize in the bubble chamber and to be ejected through an orifice of the nozzle plate towards the print medium.

A control panel 581 having user selection interface 601 may also provide input 621 to the controller 571 to enable additional printer capabilities.

As described herein, the term inkjet printhead may in addition to thermal technology include piezoelectric technology, or other.

The foregoing description is presented for purposes of illustration and description of the various aspects of the invention. The descriptions are not intended to be exhaustive or to limit the invention to the precise form disclosed. The embodiments described above were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed:

1. An inkjet printhead, comprising:

a substantially rectangular heater element having a length and width dimension and a heater center such that an aspect ratio of said length dimension to said width dimension is greater than about 2.0;

a bubble chamber having a plurality of walls substantially surrounding said heater element, said heater element residing substantially centered within said bubble chamber; and a nozzle plate with a first and second surface above said bubble chamber has an orifice axially extending from said second surface to said first surface, said orifice having an orifice center in a plane substantially parallel with said first surface such that a plumb line from said orifice center is substantially offset from said heater center in a direction away from an ink via that supplies ink to the bubble chamber from an ink reservoir.

2. The inkjet printhead of claim 1, wherein said aspect ratio is greater than about 2.5.

3. The inkjet printhead of claim 2, wherein said length dimension is about 35 microns and said width dimension is about 13 microns.

4. The inkjet printhead of claim 1, wherein said aspect ratio is about 4.0.

5. The inkjet printhead of claim 3, wherein said length dimension is about 40 microns and said width dimension is about 10 microns.

6. The inkjet printhead of claim 1, wherein an offset distance between said plumb line and said heater center is in a range from about 6 to about 10 micrometers.

7. The inkjet printhead of claim 1, wherein said heater element has a heater surface, further including an ink flow channel through one of said plurality of walls having a primary direction of ink flow substantially paralleling said length dimension on said heater surface.

8. The inkjet printhead of claim 1, wherein said bubble chamber is formed in said nozzle plate.

9. The inkjet printhead of claim 1, wherein said bubble chamber has a chamfered corner region.

10. An inkjet printhead, comprising:

a substantially rectangular heater element having a length and width dimension and a heater center such that an aspect ratio of said length dimension to said width dimension is greater than about 2.5;

a bubble chamber having a plurality of walls substantially surrounding said heater element, said heater element residing substantially centered within said bubble chamber;

an ink via that supplies ink to the bubble chamber from an ink reservoir; and a nozzle plate with a first and second surface above said bubble chamber has an orifice axially extending from said second surface to said first surface, said orifice having an orifice center in a plane substantially parallel with said first surface such that a plumb line from said orifice center has an offset distance from said heater center in a range from about 6 to about 10 micrometers and is in a direction way from said ink via.

11. The inkjet printhead of claim 10, wherein said aspect ratio is about 4.0.

12. The inkjet printhead of claim 11, wherein said length dimension is about 40 microns and said width dimension is about 10 microns.

13. The inkjet printhead of claim 10, wherein said offset distance is about 8 microns.

14. The inkjet printhead of claim 10, wherein said bubble chamber has a length dimension of about 42 microns and a width dimension of about 31 microns.

15. The inkjet printhead of claim 10, wherein said orifice has a diameter of about 14 microns in said plane substantially parallel with said first surface.

16. The inkjet printhead of claim 10, wherein said orifice has a frustum conical shape between said second and first surfaces.

17. An inkjet printhead, comprising:

a substantially rectangular heater element with a periphery having a length and width dimension and a heater center on a heater surface thereof such that an aspect ratio of said length dimension to said width dimension is greater than about 2.5;

a bubble chamber having a plurality of perpendicularly arranged walls rising above said heater element to substantially surround said heater surface of said heater element, said heater element residing substantially centered within said bubble chamber;

an ink via, having a longitudinal extent, that supplies ink to the bubble chamber from an ink reservoir:

an ink flow channel through one of said plurality of walls having a primary direction of ink flow defined by two substantially parallel ink flow walls that are substantially parallel to said length dimension on said heater surface, said parallel ink flow walls existing substantially perpendicular to said longitudinal extent to fluidly connect said heater element to said ink via; and a nozzle plate with a first and second surface above said bubble chamber has an orifice axially extending from said second surface to said first surface, said orifice having an orifice center in a plane substantially parallel with said first surface such that a plumb line from said orifice center intersects said heater surface and has an offset distance from said heater center in a range from about 6 to about 10 micrometers and is in a direction away from said ink via, said offset distance all on said heater surface and all within said periphery.

18. The inkjet printhead of claim 17, wherein said bubble chamber is formed in said nozzle plate.

19. The inkjet printhead of claim 17, wherein ink flow channel is formed in said nozzle plate.

20. The inkjet printhead of claim 17, further including a supply of ink.

* * * * *